US009988171B2

(12) United States Patent
Dahlmann et al.

(10) Patent No.: US 9,988,171 B2
(45) Date of Patent: Jun. 5, 2018

(54) COLLARED WRAP DISPENSER

(71) Applicant: Pratt Industries, Inc., Conyers, GA (US)

(72) Inventors: Deborah A. Dahlmann, Marietta, GA (US); Christopher M. Stanton, Peachtree City, GA (US); John Richard Muse, Douglasville, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 544 days.

(21) Appl. No.: 14/642,940

(22) Filed: Mar. 10, 2015

(65) Prior Publication Data

US 2016/0264277 A1 Sep. 15, 2016

(51) Int. Cl.

| | |
|---|---|
| ***B65B 67/08*** | (2006.01) |
| ***B65H 37/00*** | (2006.01) |
| ***B65H 16/00*** | (2006.01) |

(52) U.S. Cl.

CPC ..... *B65B 67/085* (2013.01); *B65H 16/005* (2013.01); *B65H 2701/1944* (2013.01)

(58) Field of Classification Search

CPC .... B65B 67/085; B65H 16/04; B65H 16/005; B65H 2402/412; B65H 2701/1944; B65H 75/18; B65H 75/185

See application file for complete search history.

(56) References Cited

U.S. PATENT DOCUMENTS

| | | | |
|---|---|---|---|
| 1,364,259 | A | 1/1921 | Eaton |
| 1,451,914 | A | 4/1923 | Kongsrud |
| 1,935,392 | A | 11/1933 | Coninck |
| 2,331,743 | A | 10/1943 | Sullivan |
| 3,856,229 | A | 12/1974 | Bryam |
| 4,102,513 | A | 7/1978 | Guard |
| 4,166,589 | A | 9/1979 | Hooever |
| 4,179,081 | A | 12/1979 | Parry |
| 4,226,380 | A | 10/1980 | Gay |
| 4,248,392 | A | 2/1981 | Parry |

(Continued)

FOREIGN PATENT DOCUMENTS

| | | |
|---|---|---|
| DE | 1924348 | 11/1970 |
| DE | 202004011730 | 11/2004 |

(Continued)

OTHER PUBLICATIONS

Stanton, Christopher M.; Issue Notification for U.S. Appl. No. 14/108,881, filed Dec. 17, 2013, dated Feb. 10, 2016, 1 pg.

(Continued)

*Primary Examiner* — William A. Rivera

(74) *Attorney, Agent, or Firm* — Taylor English Duma LLP

(57) ABSTRACT

A dispenser includes a rotating member including a first end and a second end, the rotating member having an inner surface and defining an axis of rotation that extends from the first end to the second end; a holding member having an inner surface, an outer holding surface, and a collar at a first end of the holding member, the inner surface enclosing an engaging portion of the rotating member; and a cap attached to the first end of the rotating member and holding the holding member, the collar of the holding member positioned at least partially directly between an end surface at the first end of the rotating member and a stop surface of the cap.

23 Claims, 8 Drawing Sheets

(56) References Cited

U.S. PATENT DOCUMENTS

| | | | |
|---|---|---|---|
| 4,339,022 | A | 7/1982 | Hoover |
| 4,372,500 | A | 2/1983 | Saraisky |
| D268,514 | S | 4/1983 | Thompson |
| 4,477,037 | A | 10/1984 | Goldstein |
| 4,484,717 | A | 11/1984 | Goldstein |
| 4,530,473 | A | 7/1985 | Parry |
| 4,575,020 | A | 3/1986 | Strout et al. |
| 4,600,163 | A | 7/1986 | Hummel et al. |
| 4,659,031 | A | 4/1987 | Saraisky |
| 4,706,442 | A | 11/1987 | Riemenschneider |
| 4,722,493 | A | 2/1988 | Parry et al. |
| 4,752,045 | A | 6/1988 | Goldstein |
| 4,784,348 | A | 11/1988 | McDonald |
| 4,817,762 | A | 4/1989 | Powell |
| 4,834,312 | A | 5/1989 | Riemenschneider, III |
| 4,872,623 | A | 10/1989 | Parry et al. |
| 4,874,139 | A | 10/1989 | Kewin |
| 4,971,265 | A | 11/1990 | Koch |
| 5,094,395 | A | 3/1992 | Lambert |
| 5,135,179 | A | 8/1992 | Morano |
| 5,150,852 | A | 9/1992 | Hunt et al. |
| 5,186,376 | A | 2/1993 | Scharf et al. |
| 5,190,237 | A | 3/1993 | Fagan |
| 5,203,517 | A | 4/1993 | Parry et al. |
| 5,351,905 | A | 10/1994 | Ferber |
| 5,398,884 | A | 3/1995 | Stanford |
| 5,409,177 | A | 4/1995 | Parry et al. |
| 5,490,642 | A | 2/1996 | Schwartz |
| D371,298 | S | 7/1996 | Reddy |
| 5,573,630 | A | 11/1996 | Edney et al. |
| 5,664,739 | A | 9/1997 | Black et al. |
| 5,868,334 | A | 2/1999 | Cedillo |
| 5,915,642 | A | 6/1999 | Davis |
| 5,927,635 | A | 7/1999 | Black et al. |
| 5,938,142 | A | 8/1999 | Halperin |
| 5,961,063 | A | 10/1999 | Parry |
| 6,015,111 | A | 1/2000 | Berke |
| 6,019,308 | A | 2/2000 | Huang |
| 6,027,069 | A | 2/2000 | Huang |
| D424,341 | S | 5/2000 | Anderberg |
| D425,347 | S | 5/2000 | vAnderberg |
| 6,102,323 | A | 8/2000 | Riemenschneider |
| 6,227,479 | B1 | 5/2001 | Dean et al. |
| 6,227,480 | B1 | 5/2001 | Huang |
| 6,398,150 | B1 | 6/2002 | Munter et al. |
| 6,491,252 | B2 | 12/2002 | Komatsu et al. |
| 6,508,430 | B1 | 1/2003 | Rodriguez |
| 6,517,023 | B2 | 2/2003 | Rodriguez |
| 6,651,918 | B2 | 11/2003 | Huang |
| 6,676,069 | B1 | 1/2004 | Davis |
| 6,739,542 | B1 | 5/2004 | Prina et al. |
| 6,883,298 | B2 | 4/2005 | Gooding et al. |
| 6,892,975 | B2 | 5/2005 | Chen |
| 6,905,045 | B2 | 6/2005 | Yu |
| 6,926,225 | B1 | 8/2005 | Powers |
| 6,997,411 | B2 | 2/2006 | Kewin |
| 7,017,743 | B1 | 3/2006 | Patterson |
| 7,210,649 | B2 | 5/2007 | Yu Chen |
| 7,380,744 | B1 | 6/2008 | Yu Chen |
| 7,401,449 | B2 | 7/2008 | Watson et al. |
| 7,438,254 | B2 | 10/2008 | Oettershagen |
| D593,464 | S | 6/2009 | Mentis |
| 7,543,426 | B1 | 6/2009 | Phero |
| 7,552,891 | B2 | 6/2009 | Huang |
| 7,665,686 | B2 | 2/2010 | Becker et al. |
| D612,179 | S | 3/2010 | Huang |
| 7,726,600 | B2 | 6/2010 | Huang |
| 7,762,490 | B1 | 7/2010 | Yu Chen |
| 7,866,596 | B2 | 1/2011 | Yamada |
| 7,900,421 | B2 | 3/2011 | Smith |
| 7,937,915 | B2 | 5/2011 | Kohn et al. |
| 8,104,705 | B2 | 1/2012 | Yu Chen |
| 8,308,102 | B2 | 11/2012 | Lin |
| 8,317,124 | B2 | 11/2012 | Yu Chen |
| 8,468,775 | B2 | 6/2013 | Windheuser |
| 8,468,778 | B2 | 6/2013 | Windheuser |
| 8,578,683 | B2 | 11/2013 | Smith |
| 8,616,490 | B2 | 12/2013 | Blok |
| 8,622,332 | B2 | 1/2014 | Bologna |
| 8,708,267 | B2 | 4/2014 | Morgan |
| 8,783,428 | B2 | 7/2014 | Beri |
| 9,010,675 | B2 | 4/2015 | Harrison |
| 9,272,870 | B2 | 3/2016 | Stanton |
| 9,284,085 | B2 | 3/2016 | Pace |
| 9,688,507 | B2 | 6/2017 | Stanton |
| 9,908,656 | B2 | 3/2018 | Dahlmann et al. |
| 2003/0132336 | A1 | 7/2003 | Huang |
| 2004/0065577 | A1 | 4/2004 | Yu Chen |
| 2004/0084559 | A1 | 5/2004 | Fraser |
| 2004/0245282 | A1 | 12/2004 | Yu Chen |
| 2006/0032965 | A1 | 2/2006 | Yu Chen |
| 2006/0071118 | A1 | 4/2006 | Offerhaus |
| 2006/0175460 | A1 | 8/2006 | Hua |
| 2006/0237577 | A1 | 10/2006 | Chen |
| 2006/0278751 | A1 | 12/2006 | Yu Chen |
| 2007/0063092 | A1 | 3/2007 | Zevin et al. |
| 2007/0151208 | A1 | 7/2007 | Huang |
| 2008/0072538 | A1 | 3/2008 | Kohn et al. |
| 2008/0258002 | A1 | 10/2008 | Migliaccio |
| 2009/0044494 | A1 | 2/2009 | Northrup |
| 2009/0127372 | A1 | 5/2009 | Saraisky |
| 2009/0308968 | A1 | 12/2009 | Piotrowski et al. |
| 2010/0044491 | A1 | 2/2010 | Ritchey et al. |
| 2011/0095122 | A1 | 4/2011 | Yu Chen |
| 2011/0233321 | A1 | 9/2011 | Yu Chen |
| 2011/0284680 | A1 | 11/2011 | Lin |
| 2012/0153063 | A1 | 6/2012 | Furuichi |
| 2012/0181369 | A1* | 7/2012 | Blok ..... B65B 67/085 242/422.4 |
| 2013/0152384 | A1 | 6/2013 | Yu Chen |
| 2014/0116004 | A1* | 5/2014 | Pace ..... B65B 67/085 53/390 |
| 2015/0166285 | A1* | 6/2015 | Stanton ..... B65H 16/005 242/422 |
| 2016/0137454 | A1 | 5/2016 | Stanton |
| 2017/0016550 | A1 | 1/2017 | Sliger |
| 2017/0260020 | A1 | 9/2017 | Stanton |
| 2018/0022565 | A1 | 1/2018 | Dahlmann et al. |

FOREIGN PATENT DOCUMENTS

| | | |
|---|---|---|
| EP | 0030572 | 6/1981 |
| EP | 0227564 | 7/1987 |
| EP | 0310291 | 4/1989 |
| EP | 0499761 | 8/1992 |
| FR | 2588841 | 5/1988 |
| FR | 2910887 | 12/2009 |
| GB | 2055345 | 3/1981 |
| GB | 2289039 | 11/1994 |
| GB | 2299321 | 10/1996 |
| GB | 2456801 | 7/2009 |
| GB | 2478933 | 9/2011 |
| JP | H0769349 | 3/1995 |
| TW | 201026567 | 7/2010 |
| WO | 1993010006 | 5/1993 |
| WO | 1995000395 | 1/1995 |
| WO | 2007066194 | 6/2007 |

OTHER PUBLICATIONS

Stanton, Christopher M.; U.S. Patent Application entitled: Braking Wrap Dispenser having U.S. Appl. No. 15/001,281, filed Jan. 20, 2016, 30 pgs.

Stanton, Christopher M..; Non-Final Office Action for U.S. Appl. No. 15/001,281, filed Jan. 20, 2016, dated Jan. 11, 2017, 44 pgs.

Stanton, Christopher M.; Notice of Allowance for U.S. Appl. No. 15/001,281, filed Jan. 20, 2016, dated Mar. 8, 2017, 5 pgs.

Dahlmann, Deborah A.; Advisory Action for U.S. Appl. No. 14/609,567, filed Jan. 30, 2015, dated Jan. 24, 2017, 4 pgs.

Stanton, Christopher M.; Non-Final Office Action for U.S. Appl. No. 14/108,881, filed Dec. 17, 2013, dated Sep. 23, 2015, 29 pgs.

(56) References Cited

OTHER PUBLICATIONS

Stanton, Christopher M.; Notice of Allowance for U.S. Appl. No. 14/108,881, filed Dec. 17, 2013, dated Nov. 24, 2015, 5 pgs.
Dahlmann, Deborah A.; Non-Final Office Action for U.S. Appl. No. 14/609,567, filed Jan. 30, 2015, dated Jun. 16, 2016, 38 pgs.
Dahlmann, Deborah A.; U.S. Patent Application entitled: Wrap Dispenser With Flat Rim Cap, having U.S. Appl. No. 14/108,881, filed Jul. 20, 2016, 36 pgs.
Stanton, Christopher M.; Issue Notification for U.S. Appl. No. 15/001,281, filed Jan. 20, 2016, dated Jun. 7, 2017, 1 page.
Stanton, Christopher M.; Notice of Allowability for U.S. Appl. No. 15/001,281, filed Jan. 20, 2016, dated Apr. 26, 2017, 6 pgs.
Dahlmann, Deborah A.; Notice of Allowance for U.S. Appl. No. 14/609,567, filed Jan. 30, 2015, dated Jul. 6, 2017, 17 pgs.
Stanton, Christopher M.; U.S. Patent Application entitled: Braking Wrap Dispenser having U.S. Appl. No. 14/108,881, filed Dec. 17, 2013, 29 pgs.
Dahlmann, Deborah A.; U.S. Patent Application entitled: Capped Wrap Dispenser having U.S. Appl. No. 14/609,567, filed Jan. 30, 2015, 31 pgs.
Goodwrappers; "Unitization products by Goodwrappers, include hand wrappers, replacement rolls, core handwrap, generic and disposable hand wrap", Apr. 7, 2010, located at <https://web.archive.org/web/20100407080537/http:/www.goodwrappers.com/prod_unit.asp>.
Images of Braking Wrap Film Dispenser, the Dispenser publicly available prior to Dec. 17, 2012, 12 pgs.
Vestil Manufacturing; "Stretch Wrap Dispensers", located at <http://www.vestilmfg.com/products/mhequip/stretch_wrap_dispensers.htm>, Copyright 2014, accessed on Aug. 11, 2014, 2 pgs.
Dahlmann, Deborah A.; Final Office Action for U.S. Appl. No. 14/609,567, filed Jan. 30, 2015, dated Oct. 20, 2016; 11 pgs.
"Hand Savers Stretch Wrap Film Hand Dispenser" www.ebay.com; http://www.ebay.com/itm/Hand-Savers-Stretch-Wrap-Film-Hand-Dispenser-1-set-/251286375179 (Accessed Jun. 10, 2013), 3 pgs.
Stretch film—BK Holder www.benkaico.com; http://www.benkaico.com/product-area/stretch-film—bk-holder (Accessed Jun. 10, 2013), 2 pgs.
"Stretch Film Dispenser—Hand Core Insert 3" www.aaabalingandstrapping.com; http://www.aaabalingandstrapping.com/index.php?main_page=product_info&cPath=8&products_id=183&zenid=3tkfdrfajbi8ha9ducbdvfclv4 (Accessed Jun. 10, 2013), 2 pgs.
Stanton, Christopher M.; Notice of Allowance for U.S. Appl. No. 15/606,361, filed May 26, 2017, dated Dec. 14, 2017, 30 pgs.
Stanton, Christopher M.; Supplemental Notice of Allowance for U.S. Appl. No. 15/606,361, filed May 26, 2017, dated Jan. 16, 2018, 6 pgs.
Stanton, Christopher M.; Supplemental Notice of Allowance for U.S. Appl. No. 15/606,361, filed May 26, 2017, dated Dec. 28, 2017, 4 pgs.
Dahlmann, Deborah A.; Issue Notification for U.S. Appl. No. 14/609,567, filed Jan. 30, 2015, dated Feb. 14, 2018, 1 pg.
Stanton, Christopher M.; Issue Notification for U.S. Appl. No. 15/606,361, filed May 26, 2017, dated Apr. 4, 2018, 1 pg.
Stanton, Christopher M.; Supplemental Notice of Allowance for U.S. Appl. No. 15/606,361, filed May 26, 2017, dated Mar. 22, 2018, 6 pgs.
Dahlmann, Deborah; Non-Final Office Action for U.S. Appl. No. 15/215,025, filed Jul. 20, 2016, dated Apr. 30, 2018, 49 pgs.

* cited by examiner

COLLARED WRAP DISPENSER

TECHNICAL FIELD

This disclosure relates to wrap dispensers. More specifically, this disclosure relates to wrap dispensers that allow an operator to dispense rolls of film or other wrap while holding onto the wrap dispenser.

BACKGROUND

Plastic or other sheets of material are sometimes used to wrap items for transport, storage, or other various reasons. For one example among others, wraps include thin plastic films, membranes, or sheets of any suitable material and are often rolled around a cylindrical paperboard core or other similar devices such as a spool made of another material that allows the wrap to be dispensed to facilitate the wrapping of items. This can protect the items from dust, water, and other contaminants found in the environment and can hold the items together. Types of plastic wraps may include plastic stretch wrap, which is commonly rolled around a paperboard core and used to secure and protect items during a move, such as wrapping furniture or bundling objects together. In many situations, this dispensing is done manually. Accordingly, it is desirable that the method of dispensing wrap is done in a safe but efficient manner.

SUMMARY

Disclosed is a dispenser comprising a rotating member including a first end and a second end, the rotating member having an inner surface and defining an axis of rotation that extends from the first end to the second end; a holding member having an inner surface, an outer holding surface, and a collar at a first end of the holding member, the inner surface enclosing an engaging portion of the rotating member; and a cap attached to the first end of the rotating member and holding the holding member, the collar of the holding member positioned at least partially directly between an end surface at the first end of the rotating member and a stop surface of the cap.

Also disclosed is a method of assembling a wrap dispenser comprising: enclosing an engaging portion of a rotating member with a holding member; and attaching a cap proximate to a first end of the rotating member by contacting an insertion portion of the cap to an inner surface of the rotating member with a collar of the holding member positioned at least partially directly between an end surface at the first end of the rotating member and a stop surface of the cap.

Also disclosed is a method of dispensing wrap from a roll using a dispenser, the method comprising: gripping onto an outer holding surface of a holding member of the dispenser, the holding member enclosing an engaging portion of a rotating member of the dispenser, the dispenser further including: wrap wrapped around a roll-holding portion of the rotating member, and a cap attached to the first end of the rotating member and holding the holding member with a collar of the holding member positioned at least partially directly between an end surface at the first end of the rotating member and a stop surface of the cap; and dispensing the wrap by rotating the rotating member relative to the holding member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a wrap dispenser and associated methods, systems, devices, and various apparatus. In various embodiments, the dispenser includes at least one holding member and one rotating member that are joined in a rotatable fashion so that the rotating member may rotate while wrapped with wrap while the user holds the holding member. The terms "holding member" and "rotating member" may include any member that allows a user to, respectively, hold the holding member in the user's hand and allow the rotating member to freely rotate relative to the holding member. Furthermore, the term "wrap" should be interpreted broadly and should be applied to any material that is used to cover or protect objects, including but not limited to stretch wrap, film, bubble wrap, tape, foil, tissue paper, or wrapping paper. While it is particularly useful in applications for dispensing plastic film, sheets, or other wraps, it should not be so limited as it could be used with other dispensing operations or with other materials of any desired thickness that is used to cover, enclose, enwrap, or otherwise protect articles. It would be understood by one of skill in the art that the disclosed dispenser is described in but a few exemplary embodiments among many. No particular terminology or description should be considered on the disclosure or the scope of any claims issuing therefrom.

Figure 1:
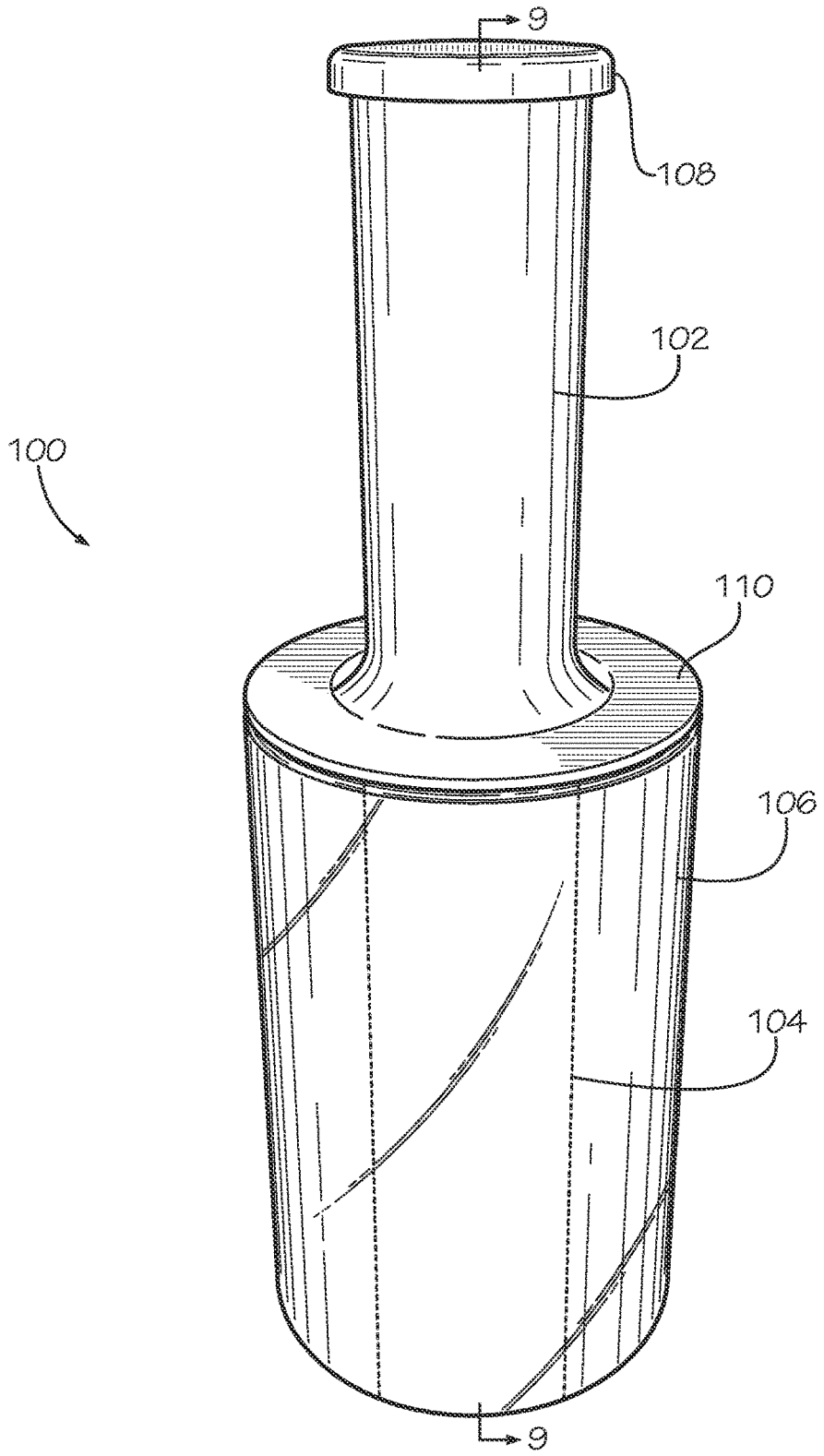
FIG. 1 is a perspective view of a wrap dispenser according to a first embodiment of the present disclosure including a holding member, a rotating member, and a cap.

One embodiment of a wrap dispenser 100 is shown in FIG. 1. The wrap dispenser 100 includes a holding member 102, a rotating member 104 having a roll of wrap 106 positioned over at least a part of the rotating member 104, and a cap 108. In various embodiments, the wrap 106 is typically rolled around the rotating member 104 to create the roll of wrap 106 shown in FIG. 1. The rotating member 104 is thereby a spool around which the wrap 106 is rolled. In various embodiments, the rotating member 104 and holding member 102 are substantially annular or tubular and are separate components, though other shapes may be present in various embodiments. In the current embodiment, the rotating member 104 and holding member 102 are both right cylinders having circular ends. As shown in FIG. 1, the holding member 102 includes a flange 110.

Figure 2:
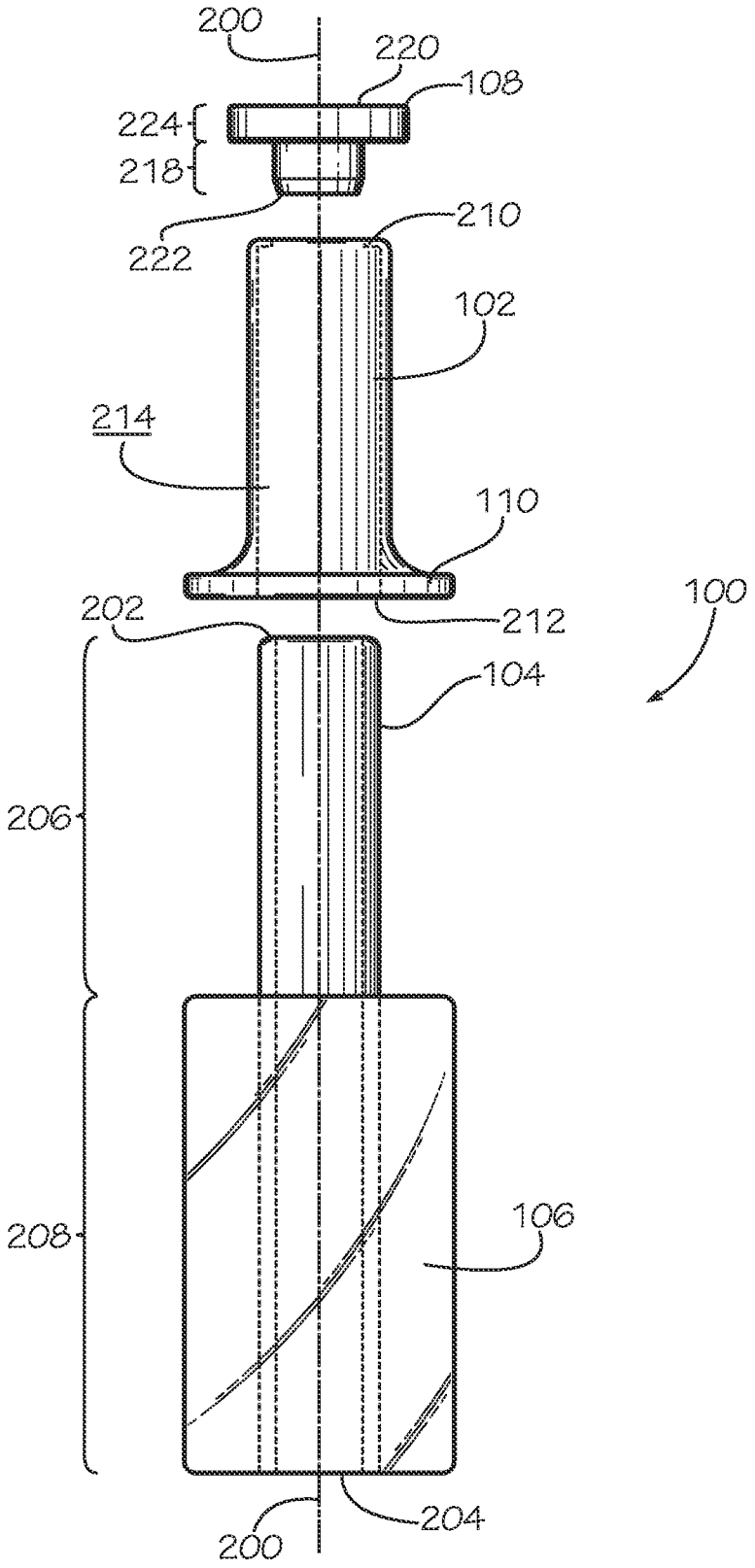
FIG. 2 is an exploded assembly view of the wrap dispenser of FIG. 1 showing how the rotating member, holding member, and a cap of the wrap dispenser are assembled.

As shown in FIG. 2, in the current embodiment, the wrap dispenser 100 includes the holding member 102, the rotating member 104 having a roll of wrap 106, and the cap 108. The wrap dispenser 100 defines a central axis 200 along which the various components of the wrap dispenser 100 are substantially aligned.

The rotating member 104 has a first end 202 and a second end 204 and includes an engaging portion 206 and a roll-holding portion 208. In various embodiments, the first end 202 defines a continuous unbroken circle and the second end 204 defines a continuous unbroken circle. In various embodiments, the rotating member 104 is a continuous cylinder such that the cross-section of the rotating member 104 is consistently circular and unbroken from end-to-end with no cuts, slots, or holes therethrough. As shown in FIG. 2, the roll of wrap 106 is positioned on the roll-holding portion 208 of the rotating member 104. The rotating member 104 will be described in greater detail below with reference to FIG. 3.

The wrap dispenser 100 also includes the holding member 102, which is positioned on the engaging portion 206 of the rotating member 104 in the assembled dispenser 100. The holding member 102 has a first end 210 and a second end 212 and defines an outer holding surface 214 that a user may hold, grab, or clench when using the wrap dispenser 100 to dispense wrap 106 such as film. In various embodiments, the first end 210 defines a continuous unbroken circle and the second end 212 defines a continuous unbroken circle. As shown in FIG. 2, in various embodiments the flange 110 is positioned on the holding member 102 at the second end 212. In various other embodiments, the flange 110 may be positioned at an intermediary position between the first end 210 and the second end 212. The flange 110 may have an annular shape with a thickness along the axis of rotation 200 and may extend radially in a direction that is perpendicular to the axis of rotation 200 to give the flange 110 a diameter that is greater than a diameter of the first end 210. The holding member 102 will be described in greater detail below with reference to FIGS. 6 and 7. In various other embodiments the flange 110 may be a separate component from the holding member 102, such as an enlarged washer between the holding member 102 and the wrap 106.

The dispenser 100 further includes the cap 108. The cap 108 defines a flange portion 224 and an insertion portion 218. As shown in FIG. 2, the cap 108 has a first end 220 and a second end 222. The cap 108 will be described below in greater detail with reference to FIGS. 4 and 5.

Figure 3:
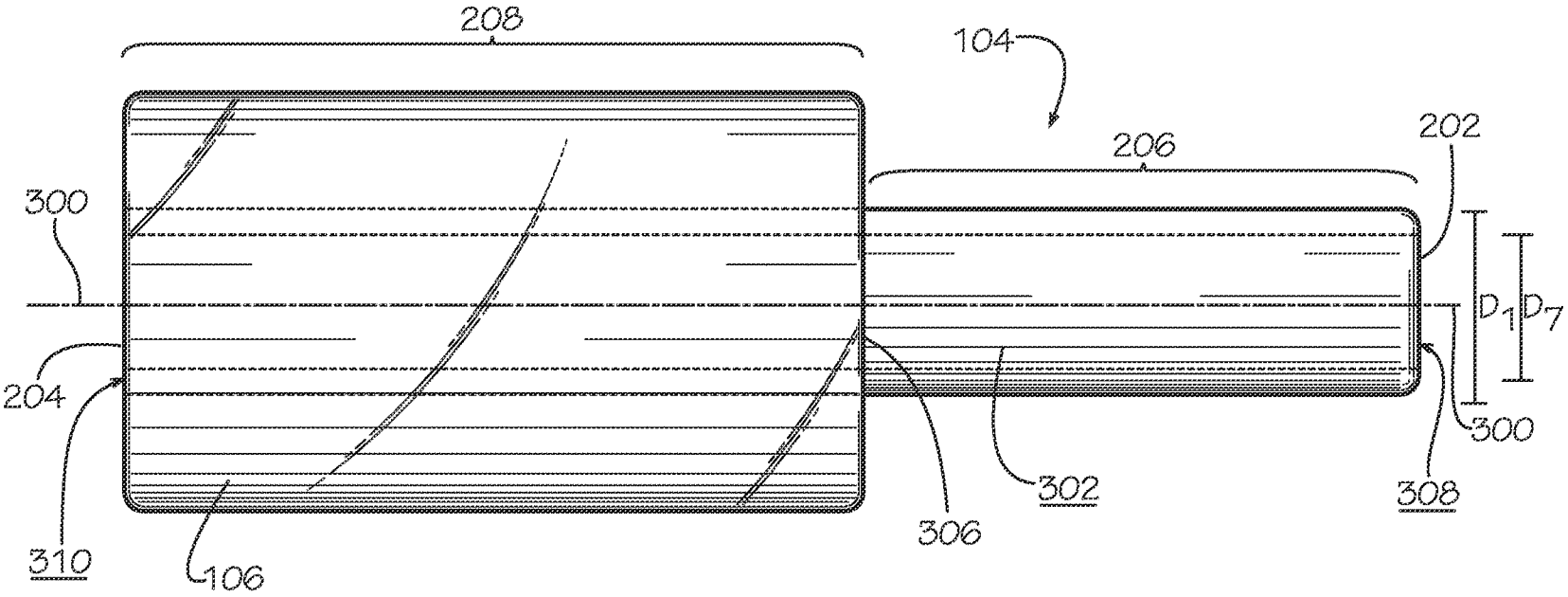
FIG. 3 is a side view of the rotating member of the wrap dispenser of FIG. 1.

As shown in FIG. 3, the rotating member 104 has a substantially annular or tubular configuration in the current embodiment. Consequently, in the current embodiment, the rotating member 104 has an outer diameter $D_1$ and an inner diameter $D_7$. The rotating member 104 also has a longitudinal axis which is the axis of rotation 300 that extends from its first end 202 to its second end 204. The rotating member 104 also includes an outer surface 302, an inner surface 304 (shown in FIG. 9), a first end surface 308, and a second end surface 310. In various embodiments, the inner surface 304 and the outer surface 302 are smooth surfaces that are substantially cylindrical. In various embodiments, the outer surface 302 defines the outer diameter $D_1$ and the inner surface 304 defines the inner diameter $D_7$.

As shown FIG. 3, the rotating member 104 includes the engaging portion 206 and the roll-holding portion 208. The engaging portion 206 is generally the area of the outer surface 302 from the first end 202 to some intermediary position 306 on the outer surface 302 of the rotating member 104 over which the holding member 102 will be positioned and a user can grasp the dispenser 100. The roll-holding portion 208 is generally the area of the outer surface 302 from the second end 204 to the intermediary position 306 on the outer surface 302 of the rotating member 104 over which the roll of wrap 106 will be positioned on the rotating member 104. In the present embodiment, the longitudinal length of the roll-holding portion 208 is greater than the longitudinal length of the engaging portion 206. However, in various other embodiments, the longitudinal length of the engaging portion 206 may be equal to or greater than the longitudinal length of the roll-holding portion 208.

In various embodiments, the outer surface 302 of the rotating member 104 in the engaging portion 206 interacts with an inner surface 216 (shown in FIG. 7) of the holding member 102, which will be described in further detail below. In the current embodiment, the roll-holding portion 208 of the rotating member 104 is substantially cylindrical and the outer surface 302 in the roll-holding portion 208 is a smooth surface. In various other embodiments, the roll-holding portion 208 of the rotating member 104 includes at least one roll grip on the outer surface 302. In these embodiments, the at least one roll grip is a rib or a raised surface protruding radially outward from the outer surface 302 on the roll-holding portion 208 of the rotating member 104. In these embodiments, the at least one roll grip engages the inside of the roll of wrap 106 in a frictionally desirable manner to help keep the roll of wrap 106 from falling off the dispenser 100.

In the current embodiment, rotating member 104 is constructed from paperboard and the inner surface 304 is a smooth cylindrical surface. In various embodiments where the dispenser 100 includes the cap 108, when assembled, the cap 108 is biased against the inner surface 304 of the rotating member 104 such that the cap 108 digs into the inner surface 304 of the rotating member 104. In various other embodiments, the cap 108 includes attachment mechanisms or connecting mechanisms such as ribs, threading, grooves, fasteners, adhesives, or various other connecting mechanisms to engage the inner surface 304. In various other embodiments, the inner surface 304 includes attachment mechanisms or connecting mechanisms positioned on the inner surface 304 proximate to the first end 202, on the outer surface 302 proximate to the first end 202, or on both the inner surface 304 and outer surface 302 proximate to the first end 202 to engage the cap 108.

Figure 4:
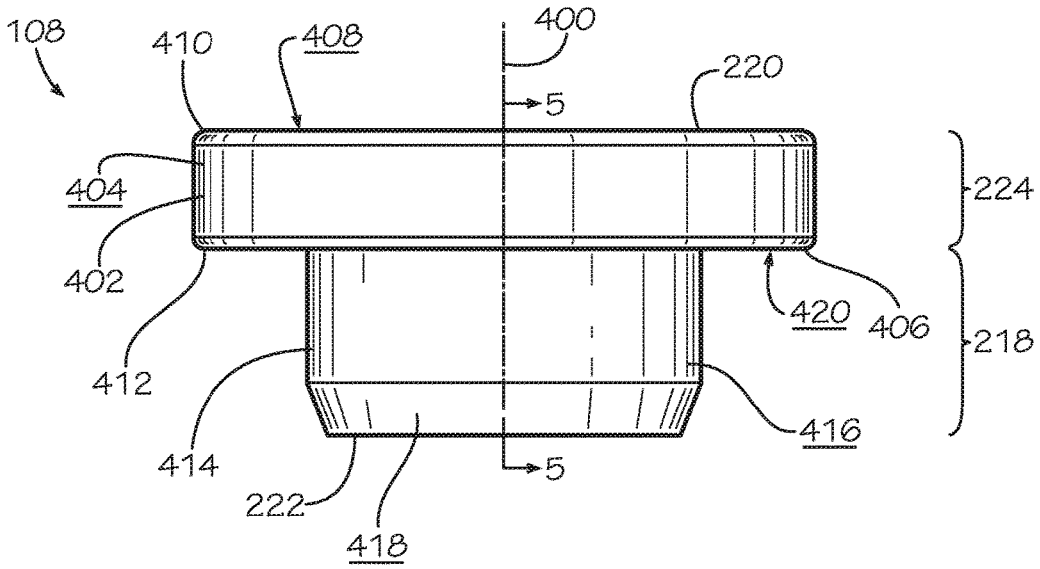
FIG. 4 is a side view of the cap of FIG. 1.

FIG. 4 shows a side view of the cap 108. The cap 108 defines a center axis 400 and includes the flange portion 224 and the insertion portion 218. The flange portion 224 includes an outer circumferential wall 402 having a side surface 404, the first end 220, and an inner end 406 with an end surface 420. As shown in FIG. 4, the cap 108 defines an outer surface 408 at the first end 220. In various embodiments, the side surface 404 intersects the first end 220 at a right angle; however, in various other embodiments, the side surface 404 may be angled relative to the first end 220. As shown in FIG. 4, in various embodiments, the cap 108 may define a tapered edge 410 between the side surface 404 and first end 220 and a tapered edge 412 between the side surface 404 and the inner end 406. In various other embodiments, the edges 410,412 may be rounded, square, or have any other desired edge shape.

As shown in FIG. 4, the insertion portion 218 has an inner circumferential wall 414 with an outer surface 416. In various embodiments, as shown in FIG. 4, the inner circumferential wall 414 also has a tapered surface 418 between the second end 222 and the outer surface 416. In various embodiments, the inner circumferential wall 414 extends partially into flange portion 224.

Figure 5:
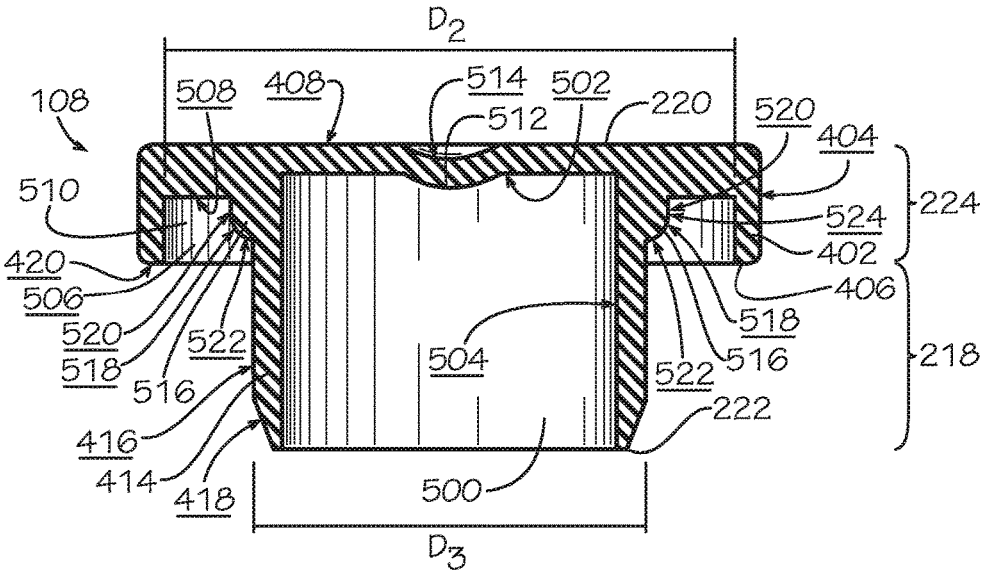
FIG. 5 is a cross-sectional view of the cap of FIG. 4 taken along line 5-5.

FIG. 5 shows a cross-sectional view of cap 108 taken along line 5-5 in FIG. 4. As shown in FIG. 5, in various embodiments, the inner circumferential wall 414 defines a cavity 500 extending inward from the second end 222 into the insertion portion 218. In various embodiments, cavity 500 extends partially into flange portion 224. In various embodiments, the cavity 500 includes a bottom surface 502 and an annular or cylindrical side surface 504 extending from the bottom surface 502 to the second end 222. As shown in FIG. 5, in various embodiments, the cap 108 includes a dimple 512 on the bottom surface 502 and protruding into the cavity 500. In embodiments where the cap 108 includes the dimple 512, the outer surface 408 of the cap 108 may define a recessed surface 514 corresponding to the location of the dimple 512. As shown in FIG. 5, in various embodiments, the outer circumferential wall 402 includes an inner surface 506. In various embodiments, the cap 108 includes a stop surface 508 extending between the inner surface 506 and the outer surface 416. In combination, the stop surface 508, the inner surface 506, and the outer surface 416 define an annular pocket 510. In various embodiments, the rotating member 104 and holding member 102 are inserted into the annular pocket 510 when the cap 108 is attached to the wrap dispenser 100.

As shown in FIG. 5, in various embodiments, the cap 108 includes a shoulder 516 between the stop surface 508 and the outer surface 416 of the inner circumferential wall 414. In various embodiments, the shoulder 516 is annular and extends around the entire circumference of the inner circumferential wall 414; however, in various other embodiments, the shoulder 516 may not be annular and may not extend around the entire circumference of the inner circumferential wall 414. As shown in FIG. 5, the shoulder 516 in the current embodiment includes shoulder surface 524. In various embodiments, the shoulder surface 524 includes a horizontal surface portion 522, a curved surface portion 518, and a vertical surface portion 520; however, in various other embodiments, the shoulder 516 may have a surface with any desired shape. As shown in FIG. 5, in various embodiments, the shoulder 516 prevents the rotating member 104 from being fully inserted into the annular pocket 510. In various other embodiments, the shoulder 516 may also prevent the holding member 102 from being fully inserted into the annular pocket 510. In various embodiments, at least a portion of the shoulder surface 524 may contact a portion of the first end 210 of the holding member 102, a portion of the first end 202 of the rotating member 104, or both and prevent one or both of the rotating member 104 and holding member 102 from being fully inserted into the annular pocket 510, thereby preventing contact with the stop surface 508. In various other embodiments, the cap 108 does not include a shoulder 516 extending between the stop surface 508 and the outer surface 416 of the inner circumferential wall 414.

In various embodiments, the cap 108 has a generally circular shape with an outermost diameter $D_2$ of the pocket 510 defined by the surface 506 of the pocket 510. The cap 108 also has an inner diameter $D_3$ of the pocket 510 defined by the surface 416 of the pocket 510 at the inner circumferential wall 414. In various embodiments, a width of the annular pocket 510 is defined as the difference between $D_2$ and $D_3$. The shape of the cap 108 should not be considered limiting on the current disclosure as in various other embodiments, the cap 108 may be square, oval, angled, or have any other desired shape.

Figure 6:
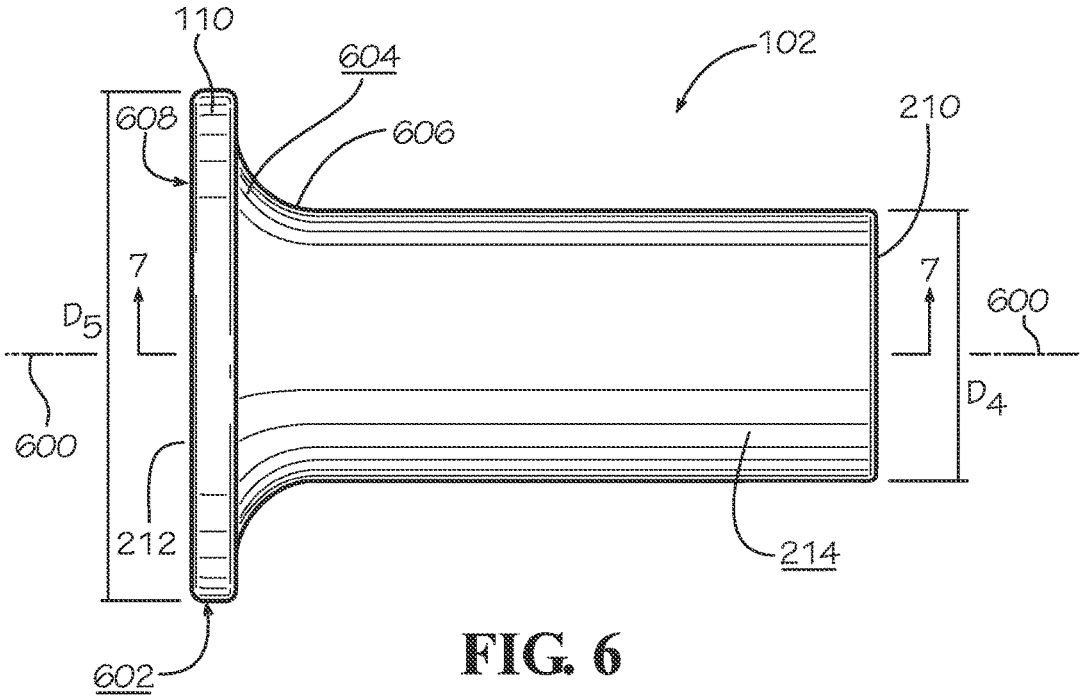
FIG. 6 is a side view of the holding member of FIG. 1.

As shown in FIG. 6, the holding member 102 has a substantially annular or tubular configuration with a longitudinal axis 600 that extends from its first end 210 to its second end 212. The holding member 102 includes the outer holding surface 214 and an inner surface 216 (shown in FIG. 7). As shown in FIG. 6, the outer holding surface 214 defines a diameter $D_4$. In various embodiments, the first end 210 defines a continuous unbroken circle and the second end 212 defines a continuous unbroken circle.

The holding member 102 also includes the flange 110. The flange 110 may protect a user's hand holding the holding member 102 from the wrap 106. In various embodiments, the flange 110 is integrally formed with the holding member 102; however in various other embodiments, the flange 110 is attached or otherwise connected to the holding member 102 with mechanisms including, but not limited to, welding, adhesives, glues, fasteners, or various other attachment mechanisms. In the present embodiment, the flange 110 has an annular shape. In various embodiments, the flange 110 defines a continuous unbroken circle. In various other embodiments, the flange 110 may have a shape that is square, oval, angled, or have any other desired shape. The shape of the flange 110 should not be considered limiting on the current disclosure. In various embodiments, the flange 110 is positioned at the second end 212 of the holding member 102; however, the location of the flange 110 should not be considered limiting as in various other embodiments, the flange is positioned at some intermediary position between the second end 212 and the first end 210.

The flange 110 has a thickness along the axis 600 and extends radially outwards from the outer holding surface 214 in a direction that is perpendicular to the axis 600 to give the flange 110 an outer diameter $D_5$ that is greater than the diameter $D_4$ of the outer holding surface 214. As shown in FIG. 6, the flange 110 defines a side flange surface 602 and an end flange surface 608. In various embodiments, the end flange surface 608 defines the roll-side surface of the second end 212 of the holding member 102. In various embodiments, the holding member 102 defines an edge surface 604 between the side flange surface 602 and an intermediary position 606 on the outer holding surface 214. In various embodiments, the edge surface 604 is curved or rounded; however, in various other embodiments, the edge surface 604 is square, angled, rounded, or have any other desired edge shape. The shape of the edge surface 604 should not be considered limiting on the current disclosure. As previously described, the user may hold, grab, or clench the outer holding surface 214 when using the wrap dispenser 100 to dispense wrap such as film.

Figure 7:
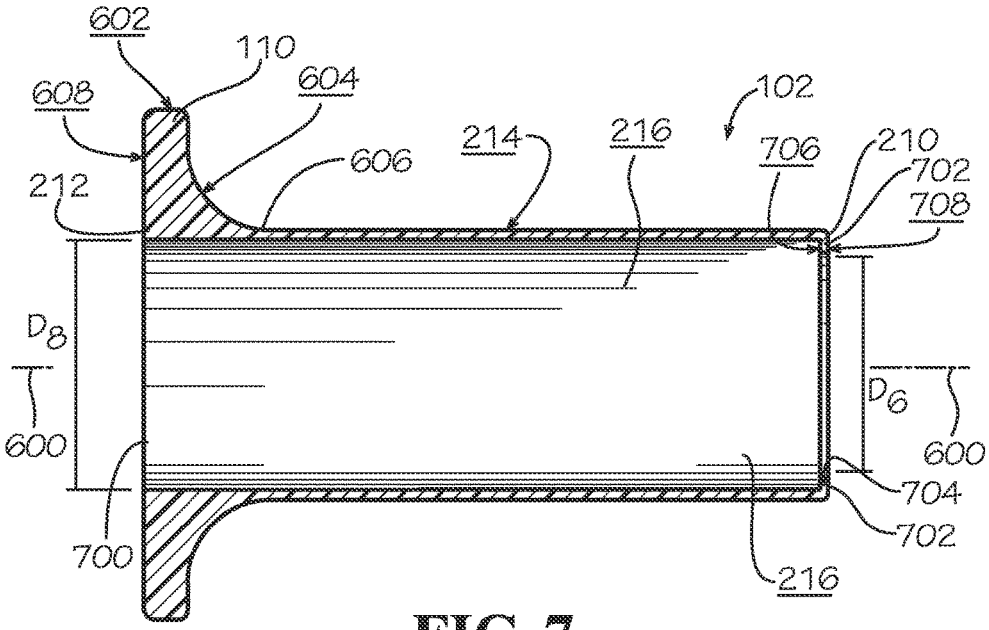
FIG. 7 is a cross-sectional view of the holding member of FIG. 6 taken along line 7-7.

As shown in FIG. 7, the inner surface 216 defines a diameter $D_8$, which is greater than rotating member diameter $D_1$ and less than the diameter $D_4$ of the outer holding surface 214. In the current embodiment, the inner surface 216 is a smooth surface that is substantially cylindrical. As described below, in various embodiments, the inner surface 216 can frictionally engage the engaging portion 206 of the rotating member 104 upon compression of the holding member 102. In various other embodiments, the inner surface 216 includes at least one roll grip on the inner surface 216. In these embodiments, the at least one roll grip is a rib or a raised surface protruding radially inward from the inner surface 216 of the holding member 102. In these embodiments, the at least one roll grip can engage the engaging portion 206 of the rotating member 104 to frictionally engage the rotating member 104. In various embodiments, the inner surface 216 defines a second end opening 700 at the second end 212 through which the rotating member 104 is positioned such that the outer surface 302 of the engaging portion 206 of the rotating member 104 faces the inner surface 216. In various embodiments, the second end opening 700 has a diameter of $D_8$.

In various embodiments, holding member 102 includes a collar 702 at the first end 210. In various embodiments, the collar 702 defines a continuous unbroken circle. The collar 702 has a thickness along the axis 600 and extends radially inwards from the inner surface 216 in a direction that is perpendicular to the axis 600. The collar 702 has an inner surface 706 and an outer surface 708. In various embodiments, the outer surface 708 is the cap-side surface of the first end 210 of the holding member 102. In various embodiments, the collar 702 is integrally formed with the holding member 102; however, in various other embodiments, the collar 702 is attached to the holding member 102 with attachment mechanisms including, but not limited to, welding, adhesives, glues, fasteners, or various other attachment mechanisms.

As shown in FIG. 7, the collar 702 defines a first end opening 704 with an inner diameter $D_6$ that is less than the diameter $D_8$ of the inner surface 216. In various embodiments, the inner diameter $D_6$ of the holding member 102 is greater than the inner diameter $D_7$ of the rotating member 104 but less than the outer diameter $D_1$ of the rotating member 104. The inner diameter $D_6$ of the holding member 102 is also greater than the inner diameter $D_3$ of the pocket 510 but less than the outermost diameter $D_2$ of the pocket 510. As will be described below, when the dispenser 100 is assembled, at least a portion of the insertion portion 218 of the cap 108 is inserted through the first end opening 704.

Figure 8:
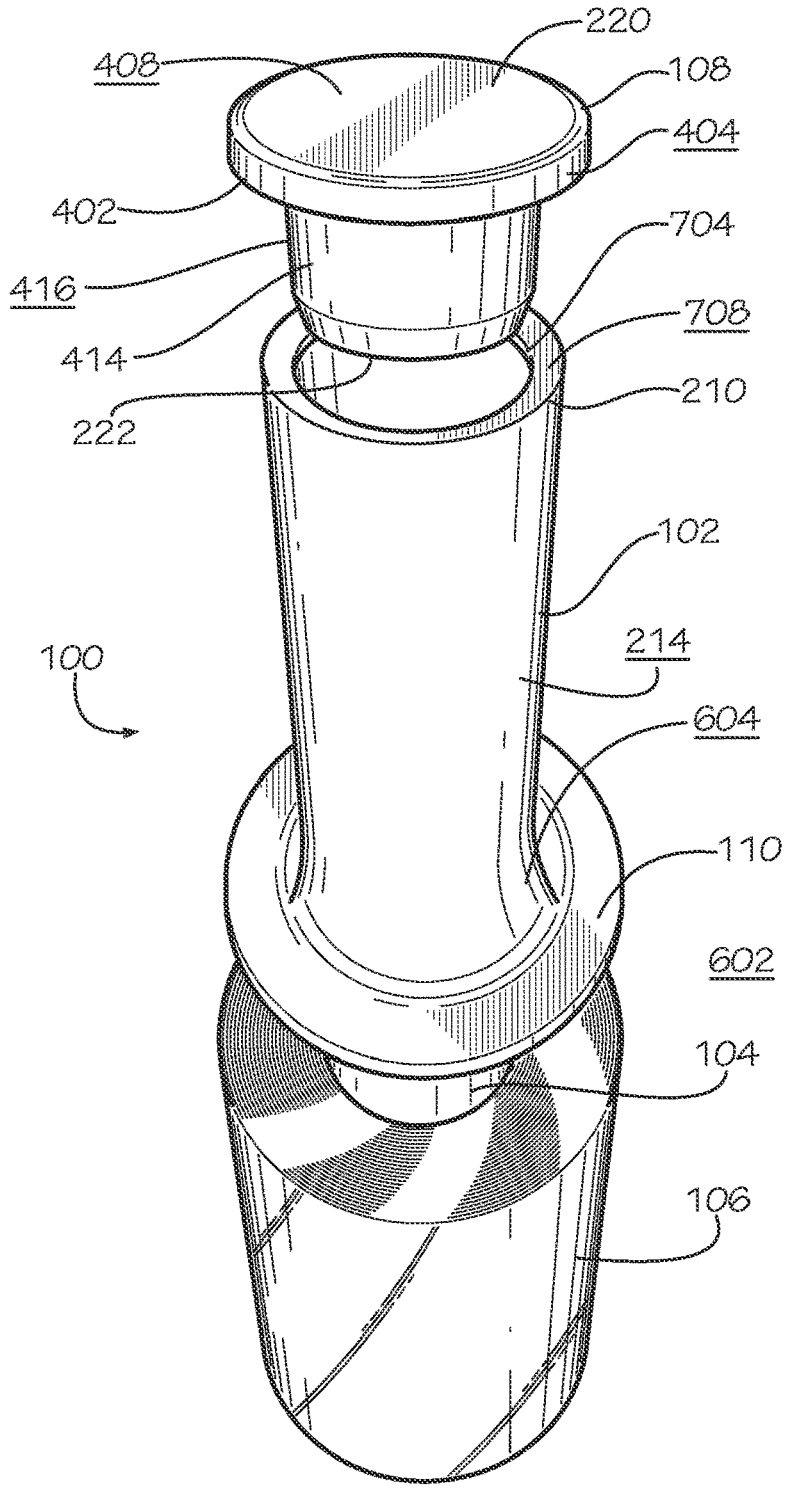
FIG. 8 is a partially-exploded perspective view of a wrap dispenser of FIG. 1.

FIG. 8 shows the wrap dispenser 100 with the holding member 102, the rotating member 104 having the roll of wrap 106, and the cap 108. As shown in FIG. 8, in various embodiments, the holding member 102 is positioned on the rotating member 104 such that the flange 110 is positioned adjacent to the roll of wrap 106. In these embodiments, the end flange surface 608 (shown in FIGS. 6 and 7) abuts the roll of wrap 106 when the dispenser 100 is fully assembled.

Figure 9:
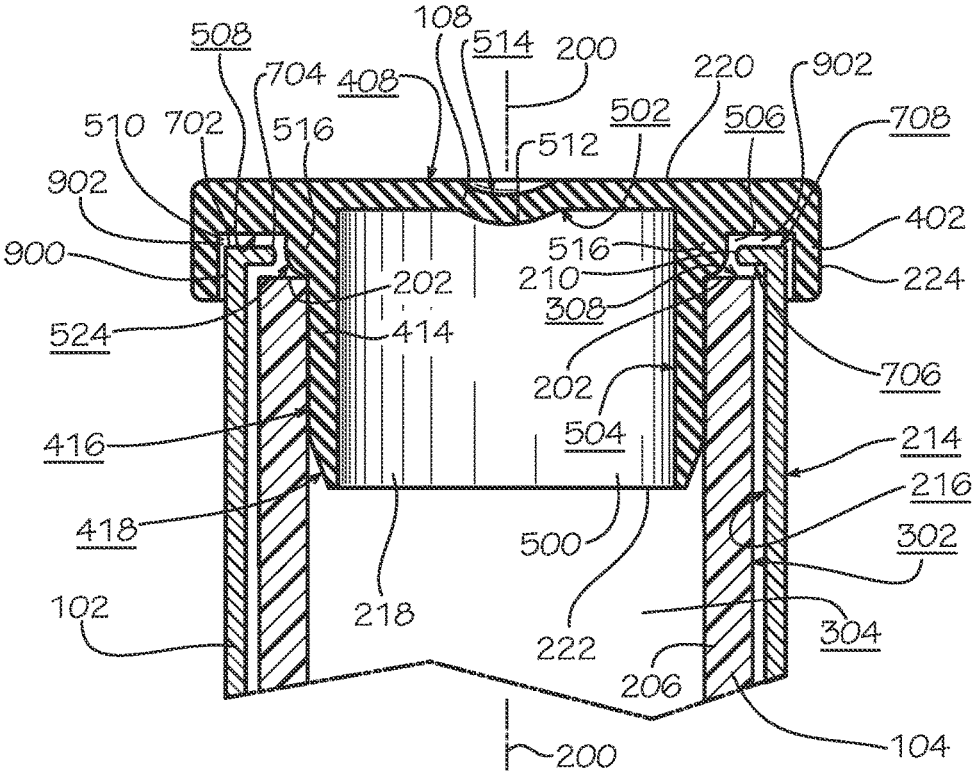
FIG. 9 is a partial cross-sectional view of the cap, holding member, and rotating member of FIG. 1 taken along line 9-9 of FIG. 1.

FIG. 9 shows the cap 108 partially inserted into the holding member 102 and rotating member 104. As shown in FIG. 9, the holding member 102 is positioned on the rotating member 104 such that the outer surface 302 of the engaging portion 206 of the rotating member 104 faces the inner surface 216 of the holding member 102. As shown in FIG. 9, when the cap 108 is inserted into the rotating member 104, at least a portion of the holding member 102 is positioned directly between the first end surface 308 of the rotating member and the stop surface 508 of the cap 108 such that at least a portion of the holding member 102 is physically between or physically positioned between the first end surface 308 and the stop surface 508, preventing contact between the first end surface 308 and the stop surface 508. In embodiments where the holding member 102 includes the collar 702, at least part of the collar 702 overlaps the first end 202 of the rotating member 104. In these embodiments, at least a part of the inner surface 706 faces and abuts at least a part of the first end surface 308 of the rotating member 104. As shown in FIG. 9, in these embodiments, the collar 702 is positioned at least partially directly between the first end surface 308 and the stop surface 508 such that at least a portion of the collar 702 is physically between or physically positioned between the first end surface 308 and the stop surface 508, preventing contact between the first end surface 308 and the stop surface 508. In various embodiments, slidably positioning the holding member 102 on the rotating member 104 allows the inner surface 706 to frictionally engage the first end surface 308 by directly contacting and engaging the first end surface 308, thereby increasing friction between the surfaces 706,308. In various embodiments, the inner surface 706 can contact the first end surface 308 of the rotating member 104 such that the holding member 102 is slidable against the rotating member 104.

As shown in FIG. 9, when the insertion portion 218 of the cap 108 is inserted through the first end opening 704 of the holding member 102 and into the rotating member 104, the outer surface 416 of the inner circumferential wall 414 is positioned adjacent to and in contact with the inner surface 304 of the rotating member 104 such that the outer surface 416 engages the inner surface 304 upon insertion of the cap 108. In various embodiments, diameter $D_3$ of the cap 108 is approximately equal to or greater than diameter $D_7$ of the inner surface 304 such that the cap 108 stays attached to the rotating member 104. In various embodiments, when the cap 108 is attached to the rotating member 104, at least a portion of the outer circumferential wall 402 overlaps the outer holding surface 214 of the holding member 102. In various embodiments, a gap 900 is defined between the inner surface 506 of the outer circumferential wall 402 and the outer holding surface 214 such that the cap 108 is rotatable with the rotating member 104 relative to the holding member 102. In various embodiments, once the cap 108 is attached to the rotating member 104, the first end 202 of the rotating member 104 is axially between the end surface 420 of the cap 108 and the stop surface 508 of the cap 108 along the axis 200.

In various embodiments, the cap 108 detachably engages the rotating member 104 such that the cap 108 is secured to the rotating member 104 but can be removed if desired by the user. In various embodiments, this is accomplished by sizing the inner circumferential wall 414 such that the inner circumferential wall 414 is biased against and digs into the inner surface 304 of the rotating member 104 but is not too tight to pull the cap 108 away from the rotating member 104 with sufficient force by hand. In various other embodiments, the cap 108 is permanently engaged or attached to the rotating member 104. The cap 108 may also engage the rotating member 104 through various attachment mechanisms such as those in the group including, but not limited to, threading, ribs, adhesives, fasteners, or various other attachment mechanisms.

In various embodiments, once the cap 108 is attached to the rotating member 104, the cap 108 prevents or resists removal of the holding member 102 from the rotating member 104 over the first end 202 of the rotating member 104. In various embodiments, tapered surface 418 serves as a guide and a ramp to ease sliding of the insertion portion 218 into the rotating member 104. In various embodiments where diameter $D_3$ of the cap 108 is greater than diameter $D_7$ of the inner surface 304, tapered surface 418 makes it possible to slide the insertion portion 218 of the cap 108 into the rotating member 104.

In various embodiments, when the cap 108 is attached to the rotating member 104, the cap 108 abuts the holding member 102 and, in combination with the wrap 106, captures and holds the holding member 102 on the rotating member 104 between the cap 108 and the wrap 106. In the current embodiment, the cap 108 abuts the first end 210 of the holding member 102 such that the cap 108 can contact the holding member 102 and prevent the holding member 102 from sliding off the rotating member 104 over the first end 210 of the rotating member 104. As shown in FIG. 9, in various embodiments, the stop surface 508 of the cap 108 is positioned adjacent to the outer surface 708 of the collar 702 such that the outer surface 708 of the collar 702 abuts the stop surface 508 even though the holding member 102 is not attached to the cap 108. In various embodiments, the stop surface 508 can contact outer surface 708 of the collar 702 of the holding member 102 such that the holding member 102 is slidable against the cap 108.

In various embodiments, a gap 902 is defined between the stop surface 508 of the cap 108 and the first end surface 308 of the rotating member 104. In these embodiments, the gap 902 may prevent binding between the holding member 102, rotating member 104, and cap 108 when a portion of the holding member 102 and rotating member 104 are inserted into the annular pocket 510. The gap 902 allows for free and smooth rotation of the rotating member 104 and cap 108 relative to the holding member 102. As shown in FIG. 9, in various embodiments, the gap 902 is defined by at least a portion of the shoulder surface 524 of the shoulder 516 contacting the first end surface 308 of the rotating member 104. In various embodiments, at least a portion of the shoulder surface 524 contacting the first end surface 308 of the rotating member 104 defines a consistent width in the gap 902 between the stop surface 508 and the first end surface 308 around the circumference of the inner circumferential wall 414.

The cap 108 also includes the outer circumferential wall 402 at least partially overlapping the holding member 102 such that the holding member 102 is captured between the outer circumferential wall 402 and the inner circumferential wall 414. In these embodiments, the cap 108 is not attached to the holding member 102 and the holding member 102 can slide on the rotating member 104 away from cap 108 within the gap 902 between the cap 108 and the rotating member 104, though in various embodiments the wrap 106 and cap 108 may be spaced apart at a distance such that the holding member 102 cannot slide axially.

Referring back to FIGS. 2-8, a method of assembling the dispenser 100 is described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A rotating member 104 with a roll-holding portion 208, an engaging portion 206, an axis of rotation 300, and a roll of wrap 106 positioned on the roll-holding portion 208 is initially provided. The wrap 106 is typically wrapped around the rotating member 104 during the manufacturing process to form the roll of wrap 106 positioned on the rotating member 104.

A holding member 102 with a longitudinal axis 600 is positioned on the rotating member 104. The holding member 102 and rotating member 104 both have substantially cylindrical shapes, which gives the user ease of rotating the wrap dispenser 100 when assembled, ease of rotating contact between the holding member 102 and rotating member 104, ease of insertion of the rotating member 104 into the holding member 102, ease of gripping the holding member 102, ease of construction of the wrap dispenser 100, and various other benefits.

The holding member 102 encloses the engaging portion 206 of the rotating member 104 and the longitudinal axis 600 is substantially aligned with the axis of rotation 300. In particular, in the current embodiment, when the holding member 102 encloses the rotating member 104, the inner surface 216 of the holding member 102 is positioned adjacent to the outer surface 302 of the rotating member 104. Furthermore, when the holding member 102 is fully positioned onto the rotating member 104, the second end 212 is positioned adjacent to roll of wrap 106. In various embodiments where the holding member 102 includes the flange 110 at the second end 212, the holding member 102 is positioned with the end flange surface 608 adjacent to the roll of wrap 106. In various embodiments where the holding member 102 includes the collar 702 at the first end 210, the holding member 102 is positioned on the rotating member 104 with at least a part of the inner surface 706 of the collar 702 at least adjacent to the first end surface 308 of the rotating member 104. In various embodiments, the inner surface 706 contacts and engages the first end surface 308 and the collar 702 may rest on the first end surface 308.

The cap 108 is attached proximate to the first end 202 of the rotating member 104. In various embodiments, the cap 108 is attached with the center axis 400 of the cap 108 substantially aligned with the longitudinal axis 600 and axis of rotation 300. In various embodiments, the axis 300,400, 600 are substantially aligned to form the center axis 200 of the wrap dispenser 100. Attaching the cap 108 prevents removal of the holding member 102 from the rotating member 104 over the first end 202 of the rotating member 104. In particular, attaching the cap 108 captures and holds the holding member 102 on the engaging portion 206 of the rotating member 104 between the roll of wrap 106 positioned on a roll-holding portion 208 of the rotating member 104 and the first end 202 of the rotating member 104. This may prevent the holding member 102 from coming off the dispenser 100 during use. In various embodiments, the cap 108 is detachably attached to the first end 202 of the rotating member 104 and abuts the holding member 102. In these embodiments, the cap 108 includes an attachment mechanism for detachably engaging the rotating member 104.

When the cap 108 is attached to the dispenser 100, at least a part of the insertion portion 218 is inserted through the first end opening 704 defined by the collar 702 of the holding member 102 and into the rotating member 104. When attached, the stop surface 508 of the cap 108 is adjacent to the first end 210 and outer surface 708 of the holding member 102. In various embodiments, when the cap 108 is attached to the dispenser 100, the gap 902 is formed between the stop surface 508 and the first end surface 308 of the rotating member 104. This gap allows for free rotation of the rotating member 104 relative to the holding member 102 while a user holds the holding member 102 without generating any significant friction with the cap 108, which will rotate with the rotating member 104, and the holding member 102.

Figure 10:
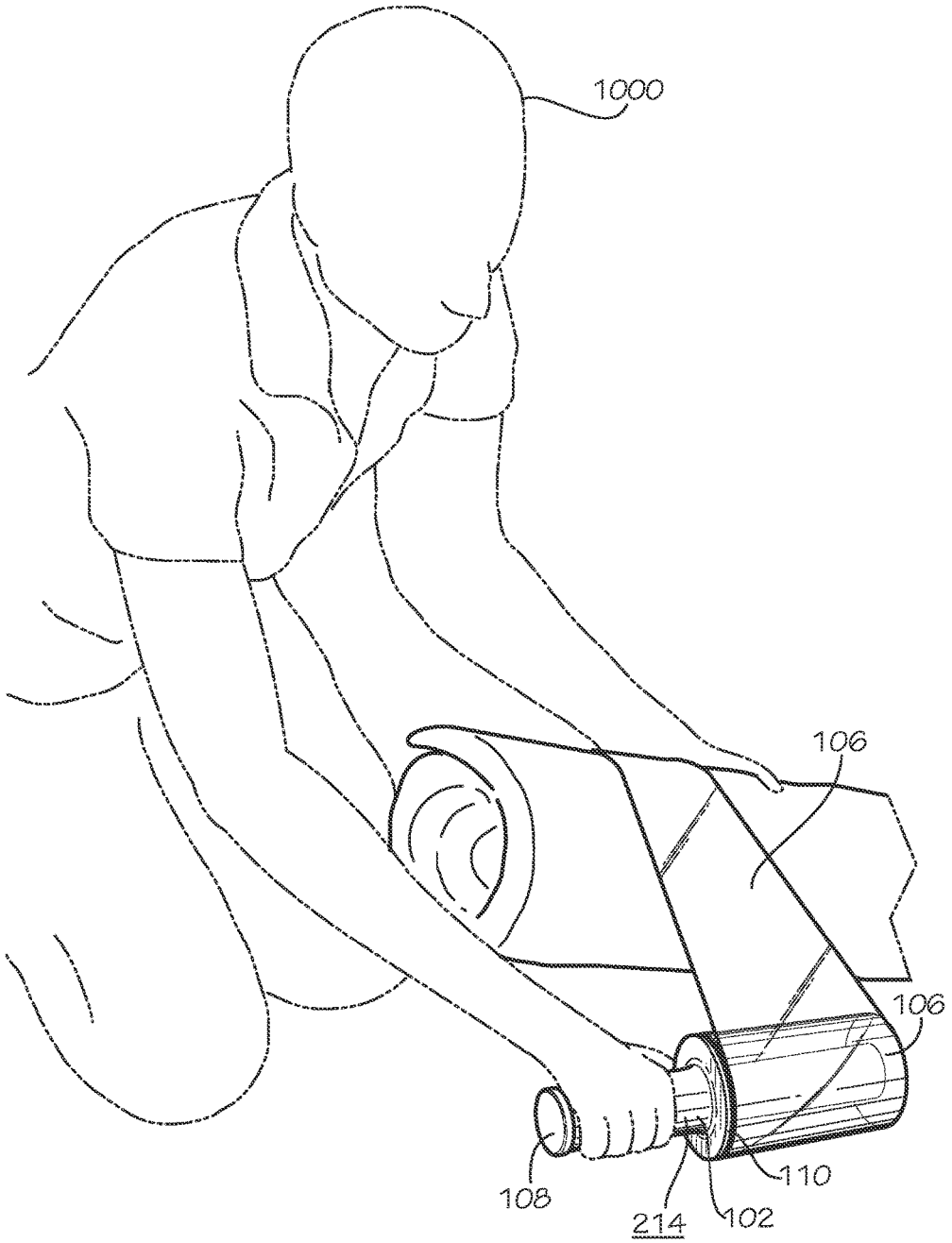
FIG. 10 is perspective view of the wrap dispenser of FIG. 1 being held and used by a user.

Focusing now on FIG. 10, a method of dispensing wrap 106 using a dispenser 100 will be described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A user 1000 first obtains a wrap dispenser 100 which includes the rotating member 104 with wrap 106 wrapped around the rotating member 104, the holding member 102 on the engaging portion 206 of the rotating member 104, and the cap 108 attached to the rotating member 104 such that the cap 108 and wrap 106 capture the holding member 102 on the engaging portion 206 of the rotating member 104.

The user 1000 holds and grips the outer holding surface 214 of the holding member 102 and begins dispensing the wrap 106 with the flange 110 separating the user from the wrap 106. Although the user 1000 is holding the holding member 102, the rotating member 104 freely rotates around its axis of rotation 300 to dispense the wrap 106 because the inner surface 216 of the holding member 102 is not compressed against the outer surface 302 of the engaging portion 206 of the rotating member 104. The inner surface 216 and outer surface 302 are sufficiently smooth in the current embodiment such that the friction between the inner surface 216 and outer surface 302 is not sufficient to significantly resist rotation of the rotating member 104.

As the wrap 106 is being dispensed, the user 1000 may increase tension in the film by clenching his or her hand and applying pressure to the holding member 102. In various embodiments, the holding member 102 directly engages the rotating member 104 when compressed to stop rotation of the rotating member 104. In particular, frictional engagement occurs when the inner surface 216 of the holding member 102 directly engage the outer surface 302 of the rotating member 104 after the inner surface 216 collapses during compression. This frictional engagement increases friction between the rotating member 104 and the holding member 102 due to the increased surface contact between the inner surface 216 and the outer surface 302 and causes the rotating member 104 to slow down or stop rotating altogether. This results in tensioning or even stretching of the wrap to occur when the user 1000 holds the dispenser 100 in place or continues to move the dispenser 100 with the roll of wrap 106, as previously described. Thus the dispenser 100 holds the wrap taut around the object or objects being wrapped, preventing the unrolled wrap from becoming loose around the object or objects or during the dispensing.

In various other embodiments, the user 1000 may also slide the holding member 102 along the rotating member 104 while clenching the holding member 102 such that the outer surface 708 of the holding member 102 frictionally engages the stop surface 508 of the cap 108. In various embodiments, the inner surface 706 of the collar 702 of the holding member 102 may also contact and frictionally engage the first end surface 308 of the rotating member 104. In these embodiments, the frictional engagement between any the compressed holding member 102 and the rotating member 104, between the collar 702 and the rotating member 104, and between the holding member 102 and the cap 108, either individually or in any desired combination, causes the rotating member 104 to slow down or stop rotating altogether. This results in tensioning or even stretching of the wrap to occur when the user holds the dispenser 100 in place or continues to move the dispenser 100 with the roll of wrap 106, as previously described.

This assembly configuration represents one of many possible assembly configurations. One skilled in the art will understand that obvious variations of this assembly configuration are included within this disclosure, including variations of steps, combinations of steps, and dissections of steps, among others. Where materials are chosen for the elements of this assembly, particularly corrugated or uncorrugated paperboard, rubber, metal, and plastic, similar material choices may also be used and would be obvious to one in the art. In particular, the rotating member 104 and/or holding member 102 is constructed from the group including, but not limited to, corrugated or uncorrugated paperboard, cast iron, steel, aluminum, titanium, copper, brass, various plastics, resins, composites, or any material of sufficient strength to withstand the loads placed on them when dispensing film or other wrap materials from a roll but resilient enough to allow compression of the holding member 102 to frictionally engage the rotating member 104, or any combination of the foregoing materials. In particular, in various embodiments, the holding member 102 and the rotating member 104 are made from a corrugated paperboard. In various other embodiments, the holding member 102 may be made from polyethylene foam and the rotating member is made from plastic or corrugated paperboard. The cap 108 is constructed from the group including, but not limited to, flexible and resilient material that may be selectively compressed or deformed to allow detachable engagement with the rotating member 104 such as a plastic or rubber-like material. In various other embodiments, only a portion of the cap 108 is constructed from plastic or rubber-like material. Another portion may be constructed from various other metals, plastics, resins, composites, or other material that need not be flexible and resilient. Furthermore, the configuration of either member need not be annular but could be another configuration depending on the application. Finally, additional members may be added to the wrap dispenser 100 and various components may be split into other components. For one example among others, an elastomeric component may be applied to the outer holding surface 214 of the holding member 102 to aid in grip. In such a case, the elastomeric component would be considered a portion of the holding member 102. This elastomeric component could be added to a plastic holding member 102 using molding technology or methods known in the art.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A dispenser comprising:

a rotating member including a first end and a second end, the rotating member having an inner surface and defining an axis of rotation that extends from the first end to the second end;

a holding member having an inner surface, an outer holding surface, and a collar at a first end of the holding member, the inner surface enclosing an engaging portion of the rotating member; and a cap attached to the first end of the rotating member and holding the holding member, the collar of the holding member positioned at least partially directly between an end surface at the first end of the rotating member and a stop surface of the cap, the cap configured to rotate relative to the holding member.

2. The dispenser of claim 1, wherein the cap includes an outer circumferential wall and an inner circumferential wall, the cap enclosing a portion of the holding member between the outer circumferential wall and the inner circumferential wall.

3. The dispenser of claim 2, wherein the cap includes a shoulder between the stop surface and an outer surface of the inner circumferential wall.

4. The dispenser of claim 1, further comprising wrap rolled around the rotating member, the cap and the wrap capturing the holding member on the rotating member.

5. The dispenser of claim 1, wherein the collar defines an inner surface and wherein the inner surface of the collar is slidable against the end surface of the rotating member as the rotating member rotates relative to the holding member, and the collar defines an outer surface and the outer surface of the collar is slidable against the end surface of the cap as the cap rotates with the rotating member relative to the holding member.

6. The dispenser of claim 1, wherein:

the rotating member has a cylindrical shape;

the holding member has a cylindrical shape; and the collar defines a continuous unbroken circle.

7. The dispenser of claim 1, wherein:

the inner surface of the holding member defines a first diameter;

the collar defines an opening having a second diameter; and an outer surface of the rotating member defines a third diameter, wherein the third diameter of the rotating member is greater than the second diameter of the collar and less than the first diameter of the holding member.

8. The dispenser of claim 1, wherein the collar extends radially inward from the inner surface of the holding member.

9. The dispenser of claim 1, wherein the first end of the rotating member is axially between an end surface at an inner end of the cap and the stop surface of the cap.

10. The dispenser of claim 1, wherein:

the holding member includes a flange at a second end of the holding member; and a flange surface of the flange abuts wrap rolled around the rotating member.

11. The dispenser of claim 1, wherein the cap is rotationally fixed relative to the rotating member.

12. A method of assembling a wrap dispenser comprising:

enclosing an engaging portion of a rotating member with a holding member; and attaching a cap proximate to a first end of the rotating member by contacting an insertion portion of the cap to an inner surface of the rotating member with a collar of the holding member positioned at least partially directly between an end surface at the first end of the rotating member and a stop surface of the cap, the cap configured to rotate relative to the holding member.

13. The method of claim 12, wherein attaching the cap includes enclosing a portion of the holding member between an outer circumferential wall and an inner circumferential wall, the cap preventing removal of the holding member from the rotating member over the first end of the rotating member.

14. The method of claim 12, wherein attaching the cap includes capturing the holding member to the engaging portion of the rotating member between the cap and a roll of wrap positioned on a roll-holding portion of the rotating member.

15. The method of claim 12, wherein the collar defines an inner surface and wherein the inner surface of the collar is slidable against the end surface of the rotating member as the rotating member rotates relative to the holding member.

16. The method of claim 12, wherein:

the holding member includes the collar at a first end of the holding member;

the holding member includes a flange at a second end of the holding member; and enclosing an engaging portion of the rotating member includes positioning a flange surface of the flange adjacent to a roll of wrap positioned on a roll-holding portion of the rotating member.

17. The method of claim 12, wherein the cap is rotationally fixed relative to the rotating member.

18. A method of dispensing wrap from a roll using a dispenser, the method comprising:

gripping onto an outer holding surface of a holding member of the dispenser, the holding member enclosing an engaging portion of a rotating member of the dispenser, the dispenser further including:

wrap wrapped around a roll-holding portion of the rotating member, and a cap attached to the first end of the rotating member and holding the holding member with a collar of the holding member positioned at least partially directly between an end surface at the first end of the rotating member and a stop surface of the cap, the cap configured to rotate relative to the holding member; and dispensing the wrap by rotating the rotating member relative to the holding member.

19. The method of claim 18, wherein the cap includes an outer circumferential wall and an inner circumferential wall, the cap enclosing a portion of the holding member between the outer circumferential wall and the inner circumferential wall.

20. The method of claim 18, further comprising applying pressure onto the holding member to increase the tension in the wrap being dispensed.

21. The method of claim 20, wherein applying pressure onto the holding member includes compressing the holding member to engage the rotating member, and wherein compressing the holding member includes increasing the resistance to rotation of the rotating member and tension in the wrap by increasing the friction between the rotating member and the holding member.

22. The method of claim 18, further comprising slidably positioning the holding member on the rotating member to engage an inner surface of the collar with the end surface of the rotating member, wherein engaging the inner surface of the collar with the end surface of the rotating member increases the resistance to rotation of the rotating member and tension in the wrap by increasing the friction between the rotating member and the holding member.

23. The method of claim 18, wherein the cap is rotationally fixed relative to the rotating member.

* * * * *